US006354532B1

(12) United States Patent
Escobedo

(10) Patent No.: US 6,354,532 B1
(45) Date of Patent: Mar. 12, 2002

(54) TOILET PAPER DISPENSING SYSTEM

(76) Inventor: Esperanza Escobedo, 4320 Olcott Ave., East Chicago, IN (US) 46312

( * ) Notice: Subject to any disclaimer, the term of this patent is extended or adjusted under 35 U.S.C. 154(b) by 0 days.

(21) Appl. No.: 09/500,767

(22) Filed: Feb. 8, 2000

(51) Int. Cl.[7] ..... B65H 16/04; B65H 19/10
(52) U.S. Cl. ..... 242/560; 242/597.7
(58) Field of Search ..... 242/560, 560.2, 242/561, 597.7, 597.8, 588.6

(56) References Cited

U.S. PATENT DOCUMENTS

| | | | | | |
|---|---|---|---|---|---|
| 2,991,951 | A | * | 7/1961 | Carroll | 242/597.7 |
| 3,168,258 | A | * | 2/1965 | Schwartz | 242/597.8 |
| 4,463,912 | A | * | 8/1984 | Grunerad | 242/560.2 |
| 4,607,809 | A | * | 8/1986 | Sineni et al. | 242/560 |
| 4,684,075 | A | * | 8/1987 | Francis | 242/560 |
| 4,765,475 | A | * | 8/1988 | Kaysserian | 242/560.2 |
| D307,086 | S | * | 4/1990 | Van Marcke et al. | |
| 5,040,679 | A | * | 8/1991 | Rehmann | 242/560 |
| 5,104,001 | A | * | 4/1992 | Negron | 221/276 |
| 5,301,888 | A | * | 4/1994 | Danzi | 242/560 |
| 5,855,338 | A | * | 1/1999 | Berger | 242/560 |
| 6,062,422 | A | * | 5/2000 | Ellis | 242/560.2 |

FOREIGN PATENT DOCUMENTS

| | | | | |
|---|---|---|---|---|
| GB | 2077700 | * | 12/1981 | 242/597.7 |

* cited by examiner

*Primary Examiner*—John M. Jillions

(57) ABSTRACT

A toilet paper dispensing system including a mounting member securable to a ceiling within a bathroom. An elongated paper holding tube is coupled with the mounting member. The paper holding tube has a central post extending downwardly therefrom. The paper holding tube has an access opening therein disposed upwardly of an open lower end thereof. An end cap is adapted for removable coupling with the open lower end of the paper holding tube. The end cap has a central post extending upwardly therefrom. A lock mechanism is disposed within the end cap for selectively locking the end cap with respect to the paper holding tube.

4 Claims, 2 Drawing Sheets

TOILET PAPER DISPENSING SYSTEM

BACKGROUND OF THE INVENTION

1. Field of the Invention

The present invention relates to a toilet paper dispensing system and more particularly pertains to holding a plurality of rolls of toilet paper for systematic use with a toilet paper dispensing system.

2. Description of the Prior Art

The use of toilet paper dispensers is known in the prior art. More specifically, toilet paper dispensers heretofore devised and utilized for the purpose of dispensing toilet paper are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,104,001 to Negron discloses a dispenser for rolls of toilet paper. U.S. Pat. No. 4,684,075 to Francis discloses a toilet paper dispenser. U.S. Pat. No. Des. 307,086 to Van Marcke et al. discloses the ornamental design for a bathroom tissue roll dispenser. U.S. Pat. No. 4,463,912 to Grunerud discloses a multi-roll dispenser. U.S. Pat. No. 5,301,888 to Danzi discloses a storage unit and dispenser for paper product rolls. U.S. Pat. No. 4,765,475 to Kaysserian discloses a holder and dispenser for multiple rolls of tissue.

While these devices fulfill their respective, particular objective and requirements, the aforementioned patents do not describe a toilet paper dispensing system for holding a plurality of rolls of toilet paper for systematic use.

In this respect, the toilet paper dispensing system according to the present invention substantially departs from the conventional concepts and designs of the prior art, and in doing so provides an apparatus primarily developed for the purpose of holding a plurality of rolls of toilet paper for systematic use.

Therefore, it can be appreciated that there exists a continuing need for new and improved toilet paper dispensing system which can be used for holding a plurality of rolls of toilet paper for systematic use. In this regard, the present invention substantially fulfills this need.

SUMMARY OF THE INVENTION

In the view of the foregoing disadvantages inherent in the known types of toilet paper dispensers now present in the prior art, the present invention provides an improved toilet paper dispensing system. As such, the general purpose of the present invention, which will be described subsequently in greater detail, is to provide a new and improved toilet paper dispensing system and method which has all the advantages of the prior art and none of the disadvantages.

To attain this, the present invention essentially comprises a mounting member securable to a ceiling within a bathroom. The mounting member has a generally circular configuration with a planar upper surface and an arcuate lower surface. The mounting member has a plurality of apertures therethrough for receiving screws for securement to the ceiling. An elongated toilet paper holding tube is coupled with the mounting member. The toilet paper holding tube has an upper end and an open lower end. The upper end is integrally formed with the arcuate lower surface of the mounting member. The toilet paper holding tube has a central post extending downwardly from the upper end to a position inwardly of the open lower end. The toilet paper holding tube has an access opening therein disposed upwardly of the open lower end. The access opening has dimensions consistent with dimensions of a roll of toilet paper. The open lower end has a plurality of radially disposed slots formed therein. An end cap is adapted for removable coupling with the open lower end of the toilet paper holding tube. The end cap has an interior circular member and an exterior circular member. The interior circular member is received within the open lower end whereby the exterior circular member abuts the open lower end. The end cap has a central post extending upwardly therefrom. A lock mechanism is disposed within the end cap for selectively locking the end cap with respect to the toilet paper holding tube. The lock mechanism comprises a key hole extending through the end cap. A central tumbler is disposed within the interior circular member. A plurality of radial spring biased tabs extend outwardly from the interior circular member for selectively engaging the plurality of radially disposed slots of the toilet paper holding tube.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet paper dispensing system which has all the advantages of the prior art toilet paper dispensers and none of the disadvantages.

It is another object of the present invention to provide a new and improved toilet paper dispensing system which may be easily and efficiently manufactured and marketed.

It is a further object of the present invention to provide a new and improved toilet paper dispensing system which is of durable and reliable construction.

An even further object of the present invention is to provide a new and improved toilet paper dispensing system which is susceptible of a low cost of manufacture with regard to both materials and labor, and which accordingly is then susceptible of low prices of sale to the consuming public, thereby making such a toilet paper dispensing system economically available to the buying public.

Even still another object of the present invention is to provide a new and improved toilet paper dispensing system for holding a plurality of rolls of toilet paper for systematic use.

Lastly, it is an object of the present invention to provide a new and improved toilet paper dispensing system including a mounting member securable to a ceiling within a bathroom. An elongated paper holding tube is coupled with the mounting member. The paper holding tube has a central post extending downwardly therefrom. The paper holding tube has an access opening therein disposed upwardly of an open lower end thereof. An end cap is adapted for removable coupling with the open lower end of the paper holding tube. The end cap has a central post extending upwardly therefrom. A lock mechanism is disposed within the end cap for selectively locking the end cap with respect to the paper holding tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
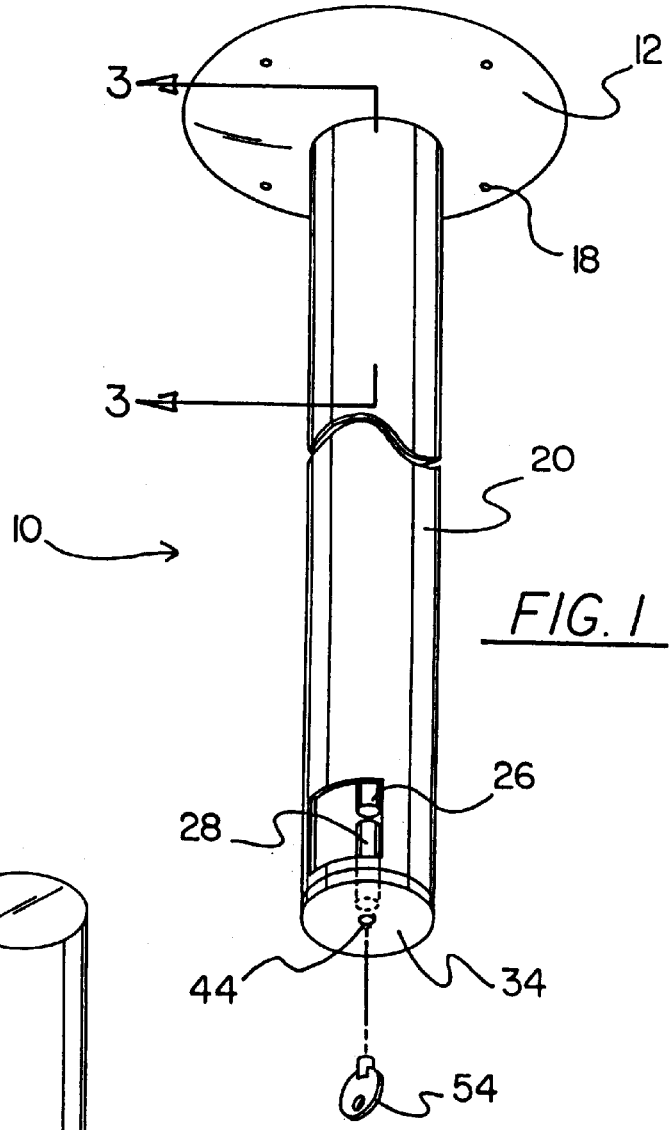
FIG. 1 is a perspective view of the preferred embodiment of the toilet paper dispensing system constructed in accordance with the principles of the present invention.
Figure 2:
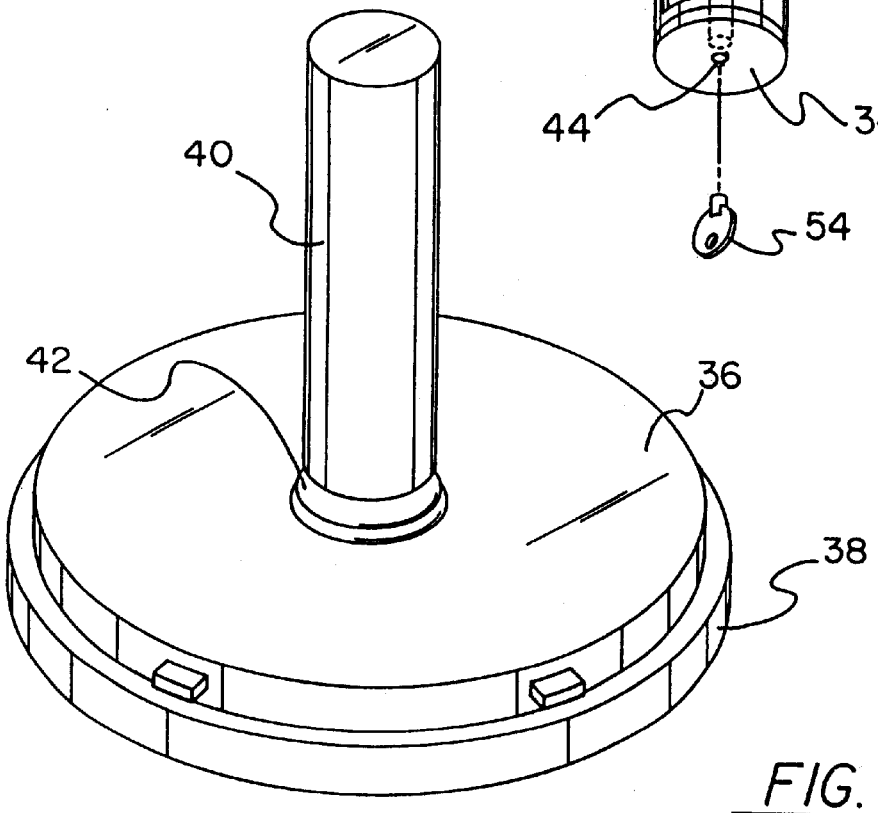
FIG. 2 is a perspective view of the removable end cap of the present invention.
Figure 3:
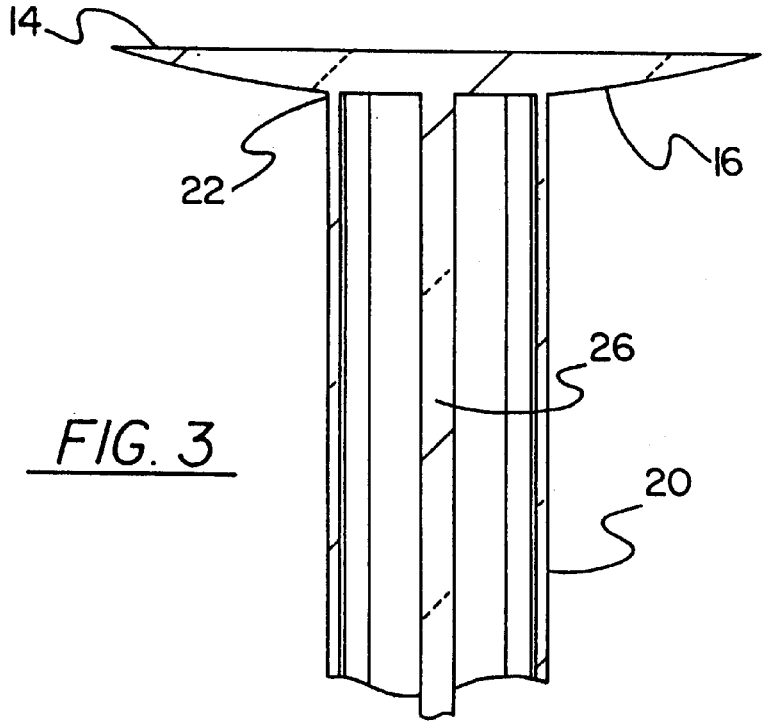
FIG. 3 is a cross-sectional view as taken along line 3—3 of FIG. 1.
Figure 4:
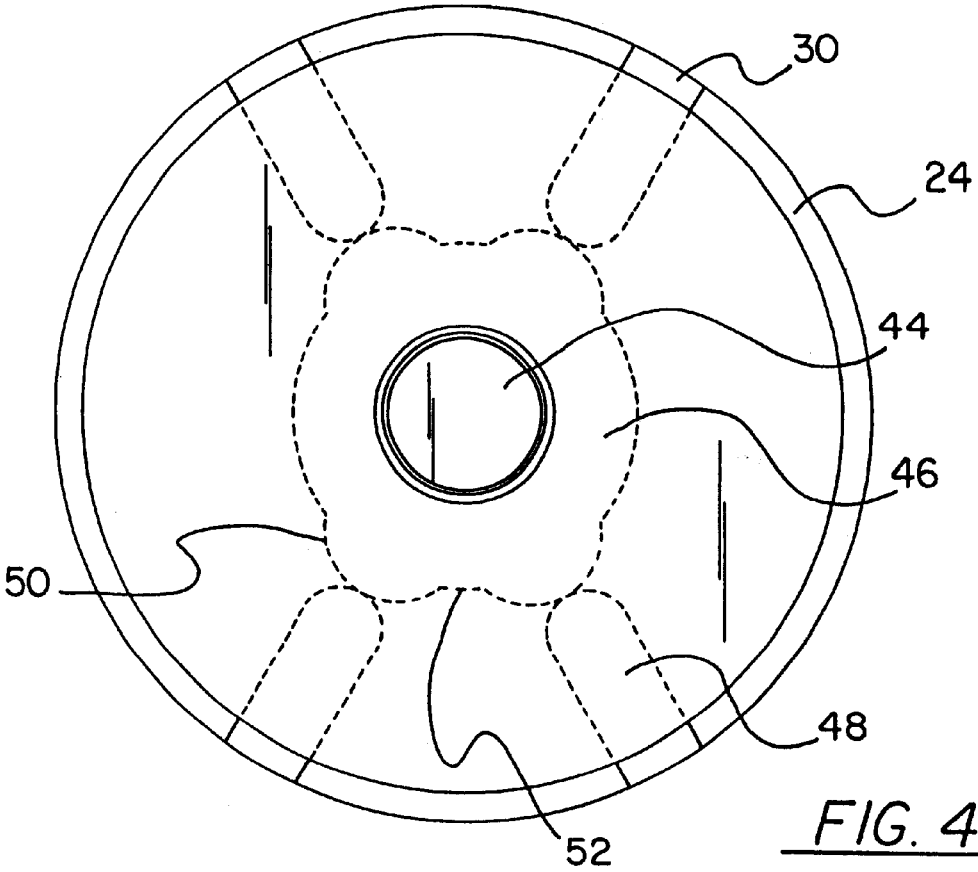
FIG. 4 is a bottom plan view of the present invention of FIG. 1.

With reference now to the drawings, and in particular, to FIGS. 1 through 4 thereof, the preferred embodiment of the new and improved toilet paper dispensing system embodying the principles and concepts of the present invention and generally designated by the reference number 10 will be described.

Specifically, it will be noted in the various Figures that the device relates to a toilet paper dispensing system for holding a plurality of rolls of toilet paper for systematic use. In its broadest context, the device consists of a mounting member, a toilet paper holding tube, an end cap and a lock mechanism. Such components are individually configured and correlated with respect to each other so as to attain the desired objective.

The mounting member 12 is securable to a ceiling within a bathroom. The mounting member 12 has a generally circular configuration with a planar upper surface 14 and an arcuate lower surface 16. The mounting member 12 has a plurality of apertures 18 therethrough for receiving screws for securement to the ceiling. In the preferred embodiment, the mounting member 12 includes four apertures.

The elongated toilet paper holding tube 20 is coupled with the mounting member 12. The toilet paper holding tube 20 has an upper end 22 and an open lower end 24. The upper end 22 is integrally formed with the arcuate lower surface 16 of the mounting member 12. The toilet paper holding tube 20 has a central post 26 extending downwardly from the upper end 22 to a position inwardly of the open lower end 24. Note FIG. 1. The toilet paper holding tube 20 has an access opening 28 therein disposed upwardly of the open lower end 24. The access opening 28 has dimensions consistent with dimensions of a roll of toilet paper. The open lower end 24 has a plurality of radially disposed slots 30 formed therein. The holding tube 20 could also be used to hold rolls of paper towels with the access opening 28 adjusted in size to accommodate the paper towels. The holding tube 20 is preferably fabricated of a transparent material so that the contents can be visualized so as to know when the toilet paper or paper towel supply is low.

The end cap 34 is adapted for removable coupling with the open lower end 24 of the toilet paper holding tube 20. The end cap 34 has an interior circular member 36 and an exterior circular member 38. The interior circular member 36 is received within the open lower end 24 whereby the exterior circular member 38 abuts the open lower end 24. The end cap 34 has a central post 40 extending upwardly therefrom. The central post 40 is secured to the end cap 34 by a spring 42. The spring 42 allows the central post 40 to be manipulated to allow an empty roll to be removed through the access opening 28. When the and cap 34 is secured to the holding tube 20, a space exists between the central post 40 and the central post 26 of the hollow tube 20 to allow the central post 40 to be manipulated to remove the empty roll. This will allow the next roll to fall into place for use.

The lock mechanism is disposed within the end cap 34 for selectively locking the end cap 34 with respect to the toilet paper holding tube 20. The lock mechanism comprises a key hole 44 extending through the end cap 34. A central tumbler 46 is disposed within the interior circular member 36. A plurality of radial spring biased tabs 48 extend outwardly from the interior circular member 36 for selectively engaging the plurality of radially disposed slots 30 of the toilet paper holding tube 20. The tabs 48 are preferably four in number to correspond with the slots 30. The central tumbler 46 is provided with four outwardly rounded portions 50 and four recessed portions 52. In a locked orientation, the rounded portions 50 will abut the tabs 48 thereby pushing the tabs 48 within the slots 30. In an unlocked orientation, a key 54 is inserted into the key hole 44 and turned thereby turning the central tumbler to align the tabs 48 within the recessed portions 52. The tabs 48 will bias within the recesses thereby disengaging the slots 30 to allow the end cap 34 to be removed from the hollow tube 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A toilet paper dispensing system for holding a plurality of rolls of toilet paper for systematic use comprising, in combination:

a mounting member securable to a ceiling within a bathroom, the mounting member having a generally circular configuration with a planar upper surface and an arcuate lower surface, the mounting member having a plurality of apertures therethrough for receiving screws for securement to the ceiling;

an elongated toilet paper holding tube coupled with the mounting member, the toilet paper holding tube having an upper end and an open lower end, the upper end integrally formed with the arcuate lower surface of the mounting member, the toilet paper holding tube having a central post extending downwardly from the upper end to a position inwardly of the open lower end, the toilet paper holding tube having an access opening therein disposed upwardly of the open lower end, the access opening having dimensions consistent with dimensions of a roll of toilet paper, the open lower end having a plurality of radially disposed slots formed therein;

an end cap adapted for removable coupling with the open lower end of the toilet paper holding tube, the end cap having an interior circular member and an exterior circular member, the interior circular member received within the open lower end whereby the exterior circular member abutting the open lower end, the end cap having a central post extending upwardly therefrom; and a lock mechanism disposed within the end cap for selectively locking the end cap with respect to the toilet paper holding tube, the lock mechanism comprising a key hole extending through the end cap, a central tumbler disposed within the interior circular member, a plurality of radial spring biased tabs extending outwardly from the interior circular member for selectively engaging the plurality of radially disposed slots of the toilet paper holding tube.

2. A paper dispensing system for holding a plurality of rolls of paper for systematic use comprising, in combination:

a mounting member securable to a ceiling within a bathroom;

an elongated paper holding tube coupled with the mounting member, the paper holding tube having a central post extending downwardly therefrom, the paper holding tube having an access opening therein disposed upwardly of an open lower end thereof;

an end cap adapted for removable coupling with the open lower end of the paper holding tube, the end cap having a central post extending upwardly therefrom; and a lock mechanism disposed within the end cap for selectively locking the end cap with respect to the paper holding tube.

3. The system as set forth in claim 2 wherein the end cap has an interior circular member and an exterior circular member, the interior circular member received within the open lower end whereby the exterior circular member abuts the open lower end.

4. The system as set forth in claim 3 wherein the lock mechanism comprises a key hole extending through the end cap, a central tumbler disposed within the interior circular member, a plurality of radial spring biased tabs extending outwardly from the interior circular member for selectively engaging a plurality of radially disposed slots formed within the open lower end of the toilet paper holding tube.

* * * * *